US006796211B1

(12) United States Patent
Braunberger

(10) Patent No.: US 6,796,211 B1
(45) Date of Patent: Sep. 28, 2004

(54) CIRCLE CUTTING MACHINE

(75) Inventor: Benjamin A. Braunberger, Fond du Lac, WI (US)

(73) Assignee: Tecre Co., Inc., Fond du Lac, WI (US)

( * ) Notice: Subject to any disclaimer, the term of this patent is extended or adjusted under 35 U.S.C. 154(b) by 0 days.

(21) Appl. No.: 10/374,883

(22) Filed: Feb. 26, 2003

(51) Int. Cl.[7] ..... B26D 1/12

(52) U.S. Cl. ..... 83/745; 30/310; 33/27.031; 83/591

(58) Field of Search ..... 30/310, 300; 83/745, 83/592, 565, 591; 33/27.03, 27.031, 27.032, 27.033

(56) References Cited

U.S. PATENT DOCUMENTS

| | | | | | |
|---|---|---|---|---|---|
| 958,941 | A | * | 5/1910 | Rose | 30/300 |
| 4,426,781 | A | | 1/1984 | Kufrin | |
| 4,548,118 | A | * | 10/1985 | Brosch | 83/522.24 |
| 4,593,467 | A | * | 6/1986 | Safar | 30/300 |
| 5,065,517 | A | * | 11/1991 | Markes | 30/300 |
| 5,860,217 | A | * | 1/1999 | Braun | 30/300 |
| D409,630 | S | | 5/1999 | Cornell et al. | |
| 6,477,930 | B1 | * | 11/2002 | Sandford | 83/162 |
| 2001/0016152 | A1 | * | 8/2001 | Ajimi et al. | 409/179 |

OTHER PUBLICATIONS

Neil Enterprises Inc., Vernon Hills, IL 2002 product catalog, p. 20 (month unknown).

* cited by examiner

*Primary Examiner*—Ken Peterson
(74) *Attorney, Agent, or Firm*—Donald Cayen

(57) ABSTRACT

A circle cutting machine includes a template that is removeably installed in the bottom of a base. On the base bottom surface are a number of segments that define respective grooves for receiving the template. The base has a cross-beam that defines an axis of rotation and that receives a handle. On one end of the handle is a crank. The handle second end holds a cutting arm. A handle spring biases the cutting arm to contact the cross-beam. The handle is slideable in the cross-beam to locate the cutting arm below the plane of the base bottom surface for easy removing of the cutting arm from the handle. An adjuster rigidly locks and resiliently unlocks the cutting arm to the handle. The template has a circular periphery that enters the base grooves, and a tab that is between two segments, when the template is installed.

6 Claims, 7 Drawing Sheets

CIRCLE CUTTING MACHINE

BACKGROUND OF THE INVENTION

1. Field of the Invention

This invention pertains to processing thin sheets, and more particularly to apparatus that accurately cuts round pieces of material from a large sheet.

2. Description of the Prior Art

It is frequently desireable to cut circular pieces from a sheet of material. A well known way to cut circular pieces is with a scissors. However, in many cases, using a scissors is not acceptable. As one drawback, an outline of the circle must first be drawn on the material. For an accurate circle, another tool, such as a compass, is required. The point of the compass invariably penetrates the material, which is highly undesireable in many situations. Further, the edge of the cut piece is only as accurate as the skill of the person can make it by simultaneously manipulating the scissors and the sheet. In addition, the compass and scissors method is laborious and time-consuming.

To overcome the problems inherent with cutting circular pieces with a scissors, circle cutting punches have been developed. The cut pieces are very accurate, and high production is obtainable. On the other hand, the dies for circle punches are expensive, and a different die is required for each size piece.

Circle cutting machines are another solution to the problem of accurately cutting circles from a sheet of material. Some prior circle cutting machines included an annular metal base with a cross-piece, a handle rotatable in the base cross-piece, a cutting arm held in the handle, and a cutting element on the cutting arm. The cutting arm was normally adjustable to enable different size circles to be cut. The base was manually held tightly over a sheet of material at the proper location such that the circle to be cut was viewable through the inside of the base. Rotating the handle while pushing it toward the sheet caused the cutting element to travel in a circle and cut the desired piece from the sheet. Neil Enterprises, Inc. of Vernon Hills, Ill., and Badge Parts, Inc. of Milwaukee, Wis., are two sources of such circle cutting machines. A few prior circle cutting machines did not not have any capability of adjusting the cutting arm; a different machine was required for each size circle to be cut.

U.S. Pat. No. 4,426,781 shows a circle cutter for making paper disks that has a very limited adjustability of the cutting arm. The cutting arm is built into an annular ring that is guided for rotation in a base. Another variation of prior circle cutting machines employs a ring that is slideable over a central plunger. The ring holds an adjustable cutting arm. The plunger is pressed against a sheet of material, and the ring is rotated to cut a circular piece. An example of the ring and plunger type circle cutting machine is disclosed in U.S. Pat. No. Des. 409,630. A somewhat similar product is marketed under the designation "NT Circle Cutter C1500." Another type of typical cutting machine is marketed by Neil Enterprises, Inc. under the trademark Creativety Cutter. That particular machine is adjustable to cut circular pieces ranging in size from approximately 2 ¼ inches to 7 ⅜ inches.

Despite the variety of prior circle cutting machines presently available, none is without limitations. A major problem with the prior machines was the difficulty in accurately positioning the machine on the sheet to be cut. In many applications, it was required to accurately cut around a pattern that was pre-printed on the sheet. The prior plunger and ring machines were especially difficult to center properly over the pattern to be cut. The plunger could smudge or smear the print on delicate materials such as photographs. Machines with annular bases and cross-pieces were also difficult to position, because the patterns were invariably smaller than the base. To assist in accurately positioning the machine on the pattern, a user sometimes bonded a piece of cardboard to the bottom of the base. The cardboard had a hole through it of the same diameter as the pattern. The cardboard served as a centering template that aided in accurately cutting the pattern. However, the cardboard had to be removed and a new cardboard bonded to the base for each size circle to be cut.

In another attempt to use a centering template, a loose piece of cardboard or similar material was inserted into an annular base from the top of the machine. It proved very difficult to manipulate the template past the base cross-piece and around the handle and cutting arm in order to properly seat it on a flange in the base. After the template finally was in place, it was spaced from the underlying sheet a distance equal to the thickness of the base flange. The distance between the template and the sheet introduced parallax, which reduced the accuracy of the centering process. Maneuvering the user's head and eyes to overcome the parallax required additional undesireable time and effort.

Another drawback of prior annular base and cutting arm machines was the difficulty in changing the cutting element when it had worn. In one prior machine, for example, the entire handle had to be disassembled from the base in order to change the cutting element. Moreover, a tool such as a screwdriver or wrench was needed for the disassembly and reassembly process. A related handicap was the difficulty in adjusting the cutting arm to the proper radius. In most cases, a trial and error procedure was required to set the proper cutting radius, and a tool was invariably needed.

In general, the prior circle cutting machines were cumbersome and time consuming to set up and operate. A need therefore exists for improvements in circle cutting machines.

SUMMARY OF THE INVENTION

In accordance with the present invention, a circle cutting machine cuts circular pieces from a sheet of material in a more efficient manner than was previously possible. This is accomplished by apparatus that includes interchangeable templates that are removeably installed from the bottom of the machine base.

The base is annular in shape, having an outer diameter, an inner diameter, and a wall. The base has a cross-beam with a center bearing that defines an axis of rotation. On the base bottom surface are a number of segments, each having an inside edge. The segments are separated from each other by circumferentially spaced gaps. The base bottom surface and the segments cooperate to define arcuate grooves having a diameter between the base inner and outer diameters.

The base center bearing receives a hollow shaft of a handle. On one end of the shaft is a crank with a hand knob. A handle spring between the crank and the base cross-beam biases the shaft to slide in an upward direction in the center bearing. On the shaft second end, on the opposite side of the base center bearing as the crank, is a cross-hole that slideingly holds a cutting arm. Upward sliding of the shaft in the center bearing is limited by contact of the cutting arm with the center bearing.

An adjuster is part of the machine handle. The adjuster includes a locking device inside the shaft that is capable of resiliently contacting the cutting arm. An adjuster knob is adjustable in the shaft to press the resilient locking device with greater or lesser force against the cutting arm. The cutting arm is free to slide in the shaft cross-hole when there is a weak force against the cutting arm. When a strong force is against the cutting arm, it is rigidly locked in place in the shaft. If desired, the cutting arm may have detents at selected locations on it.

On one end of the cutting arm is a cutting element such as a cutting wheel or a static blade. Normally, the cutting arm is inside the base wall between the cross-beam and the plane of the base bottom surface.

Another important feature of the invention is that the cutting element is very easily replaced when worn. For that purpose, the handle shaft has a relatively long length between the base center bearing and the crank. The handle is slideable in the center bearing against the handle spring a distance sufficient to locate the cutting arm completely below the plane of the base bottom surface. Consequently, the cutting arm can be removed from the shaft by loosening the adjuster knob and sliding the cutting arm out of the shaft cross-hole. In that manner, the cutting arm is removeable from the machine without the use of any tools. With the cutting arm out of the machine, the cutting element is easy to replace.

Further in accordance with the present invention, the template is made of a thin but tough and flexible material. It is formed with a circular periphery having a number of flats. The diameter of the circular periphery is slightly less than the diameter of the grooves in the base. Preferably, the number and locations of the flats correspond to the number and locations of inside edges of the segments. A tab protrudes from one of the flats.

To use the circle cutting machine, the adjuster knob is loosened. The cutting arm is slid in the handle shaft cross-hole such that the cutting element is at the desired distance from the base axis of rotation. The detents in the cutting arm aid in setting the proper location of the cutting arm within the shaft. The adjuster knob is tightened to lock the cutting arm in place.

A desired template is installed in the base. That is achieved by fitting the template flats inside the segments inside edges, and placing the template circular periphery on the base bottom surface. The template is then pivoted by means of the tab such that the junctions between the flats and the adjacent circular peripheries enter the grooves between the segments and base bottom surface. The template is pivoted until the tab is located in a gap between two segments. At that point, the template is installed, and it lies close to the base bottom surface.

If the template does not have a guide hole in it, the machine segments are placed on a hard surface. The hand knob is pushed to slide the handle in the base center bearing until the cutting element contacts the template. Then the handle is rotated while pushing on the hand knob to cut a guide hole that is the size of the pieces of material to be cut with the machine. The long handle length enables the crank to easily clear the hand of a person that holds the machine in place during operation. The machine is then laid on the sheet to be cut, and the template guide hole is centered over the pattern. The thin and flexible template material enables it to be pushed the small distance to contact the sheet and thereby eliminate any parallax. Turning the handle a few turns while pushing on the hand knob cuts a perfectly centered circular piece. At any time, the template can be removed from the machine by pivoting it to bring the circular periphery out of the segment grooves, and a new template installed.

The method and apparatus of the invention, using interchangeable templates, thus cuts exact circular pieces from a sheet of material. The probability of misaligning the machine over a pattern to be cut is remote, even though the machine can cut a large number of different circle sizes.

Other advantages, benefits, and features of the invention will become readily apparent to persons skilled in the art upon reading the detailed description of the invention in conjunction with the accompanying drawings.

DETAILED DESCRIPTION OF THE INVENTION

Figure 2:
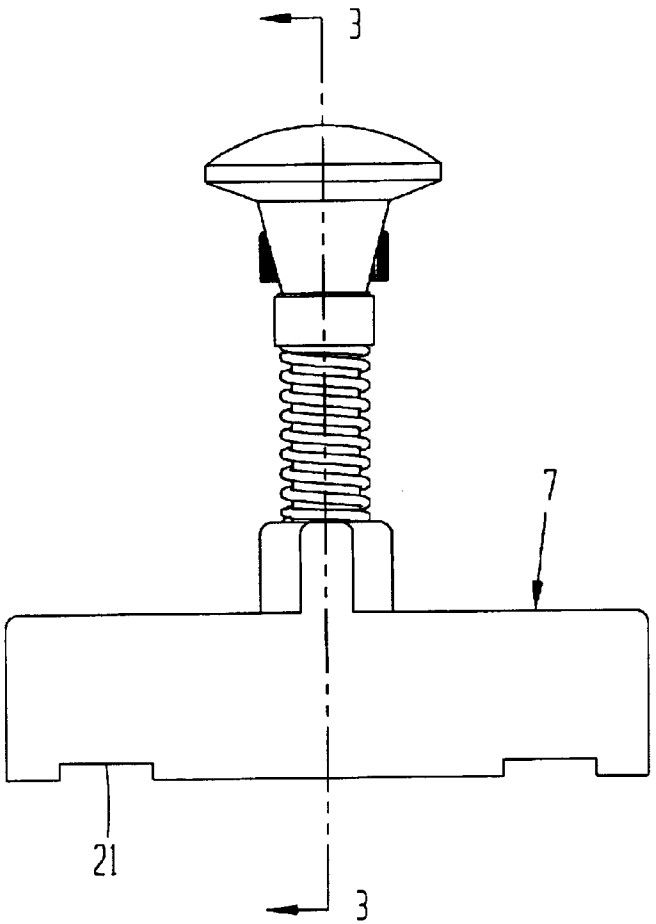
FIG. 2 is a front view of the circle cutting machine.
Figure 1:
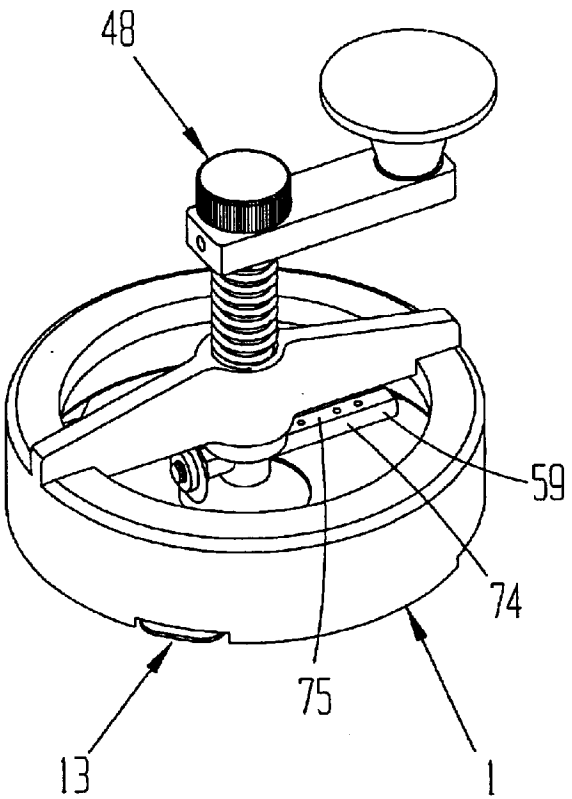
FIG. 1 is a top perspective view of the circle cutting machine of the present invention.

Although the disclosure hereof is detailed and exact to enable those skilled in the art to practice the invention, the physical embodiments herein disclosed merely exemplify the invention, which may be embodied in other specific structure. The scope of the invention is defined in the claims appended hereto.

Referring to FIGS. 1–4 and 8, a circle cutting machine 1 is illustrated that includes the present invention. The circle cutting machine 1 is particularly useful for cutting circular pieces 3 from a thin sheet 5. The sheet 5 may be any of many different materials such as paper and polyester film.

The circle cutting machine 1 is comprised of a base 7, a handle 9 rotatable in the base, a cutting arm 11 held in the handle, and a template 13 removeably installed in the base. Pushing the handle 9 toward the sheet 5 and simultaneously rotating the handle causes a cutting element 15 on the cutting arm 11 to travel in a circle and cut a piece 3 from the sheet 5.

Figure 4:
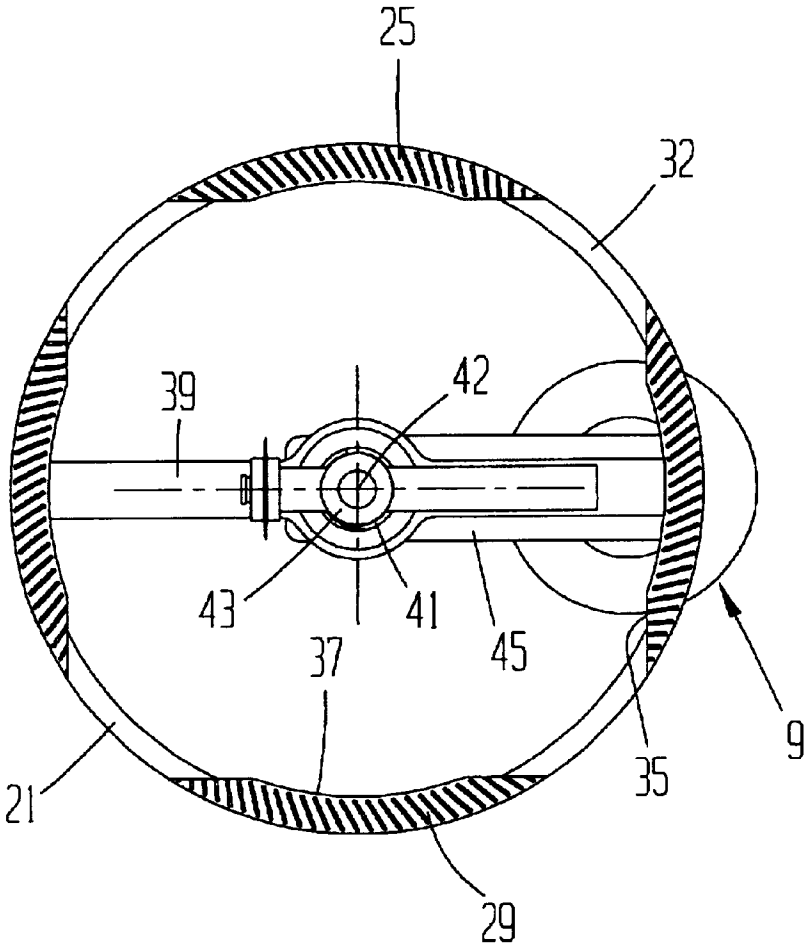
FIG. 4 is a bottom view of the circle cutting machine.

The base 7 is annular in shape, having a outer diameter 17, an inner diameter 19, a wall 20, and a bottom surface 21. If desired, the base wall inner diameter 19 may have a flange 23 near the bottom surface 21. In that case, the base bottom surface is common to the wall 20 and the flange 23. Also part of the base are a number of segments 25 on the bottom surface. In the illustrated construction, there are four segments 25 equally spaced circumferentially around the wall 20. However, there may be more or fewer than four segments, but two is the minimum number. The segments are separated by gaps 32 around the wall bottom surface. Each segment has a first leg 27 that extends from the base bottom surface. A second leg 29 is parallel to the base bottom surface. The two segment legs 27 and 29 cooperate with the bottom surface to define an arcuate groove 31 with a width W and a diameter D. The undersurface 33 of each segment is preferably knurled. Each segment second leg has a thickness T and an inside edge 35. As best shown in FIG. 4, the segment inside edges 35 have arcuate reliefs 37. The reliefs 37 enable a piece 3 to be cut that is almost as large as the diameter of the base inner diameter 19.

Diametrically spanning the base wall is a cross-beam 39 having a center bearing 41. The center bearing 41 may be a long bronze bushing, and it defines an axis of rotation 42.

In the preferred embodiment, the handle 9 is composed of a hollow shaft 43 that is free to slide and rotate in the center bearing 41. One end of a crank 45 is fixed to one end of the shaft 43, as by a set screw 47. There is a hand knob 50 on the other end of the crank 45. A handle spring 52 is interposed between the crank and the base cross-beam 39. In the second end of the shaft is a cross-hole 61.

The cutting arm 11 is comprised of a bar 59 that is slideable in the cross-hole 61 of the shaft 43. The bar 59 may be generally round in cross-section with a completely cylindrical surface 74, but it preferably has a flat surface 75. On one end of the bar is the cutting element 15. In the embodiment of the invention depicted in FIGS. 1, 3, 3A, 4, and 8, the cutting element is a cutting wheel 62, which may be retained on the bar by a snap ring 64. The cutting wheel 62 has a cutting edge 63. The handle spring 52 biases the handle 9 upwardly such that the bar is normally in contact with the bottom face 71 of the base center bearing 41. In that situation, the cutting arm is inside the base wall 20 between the plane of the base bottom surface 21 and the cross-beam 39.

Figure 10:
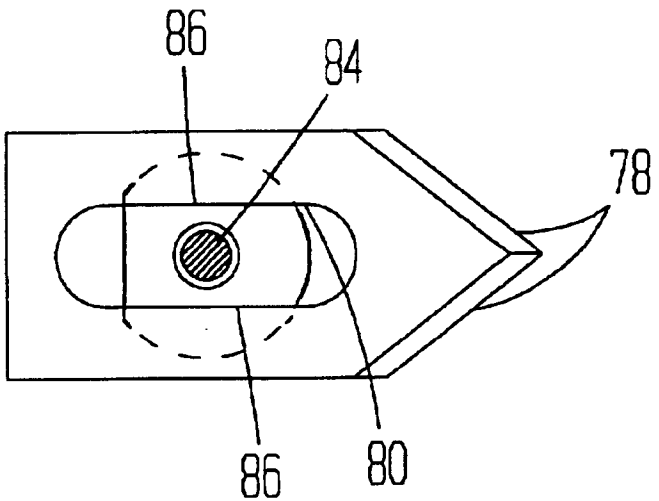
FIG. 10 is a view taken along line 10—10 of FIG. 9.
Figure 9:
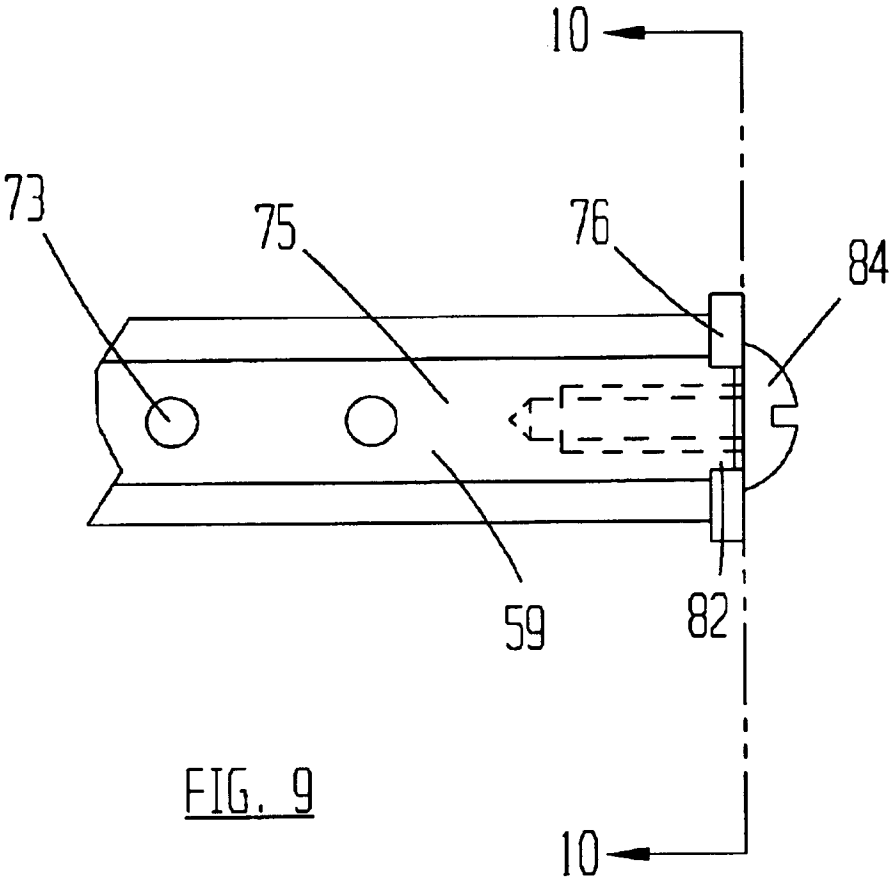
FIG. 9 is a view showing a static blade on the cutting arm bar.

FIGS. 9 and 10 show a static blade 76 as the cutting element 15. The blade 76 has a double edge 78 with steep included angles. The blade preferably has a slot 80 that is slideable over a key 82, defined by parallel flats 86, on the end of the cutting arm bar 59. A screw 84 threaded into the end of the bar retains the blade on the bar. The blade is reversible 180 degrees on the key 82 to suit whether the bar is turned to present the flat surface 75 or cylindrical surface 74 to the ball 55.

To hold the cutting arm 11 in the shaft cross-hole 61, the handle 9 further comprises an adjuster 48. According to one aspect of the invention, the adjuster 48 includes an adjuster knob 49 that is threaded into the shaft 43. Inside the shaft is a resilient locking device 54 that presses against the cutting arm bar 59 with a force dependent upon the adjustment of the adjuster knob 49. In the particular construction illustrated, the resilient locking device 54 comprises a pin 51, an adjuster spring 53, and a ball 55. The adjuster spring 53 is preferably held in a counterbore 57 in the pin 51.

To lock the cutting arm bar 59 to the handle shaft 43, the adjuster knob 49 is turned into the shaft. The knob shank 69 bears against the pin 51 and compresses the adjuster spring 53 such that the pin contacts the ball 55, and the ball presses against the cutting arm bar. See FIG. 3A. That action rigidly locks the cutting arm bar against the shaft cross-hole 61. Turning the adjuster knob out of the shaft causes the pin to lose contact with the ball. In that situation, the cutting arm bar is held in place only by a compression force exerted by the adjuster spring against the ball. The adjuster spring compression force is adjustable by turning the knob in the shaft. With a relatively small compression force, the bar is resiliently unlocked from the shaft and is easily slideable in the shaft cross-hole. To assist in locating the bar at the desired location, it has a number of detents 73 in the flat surface 75. The detents 73 are located at distances from the cutting wheel 63 that correspond to particular size pieces 3 to be cut from the sheet 5. For locking the bar at positions other than at the detents, the bar may be turned in the shaft cross-hole to present the bar cylindrical surface 74 to the ball and rigidly locked in position by turning the adjuster knob.

Figure 5:
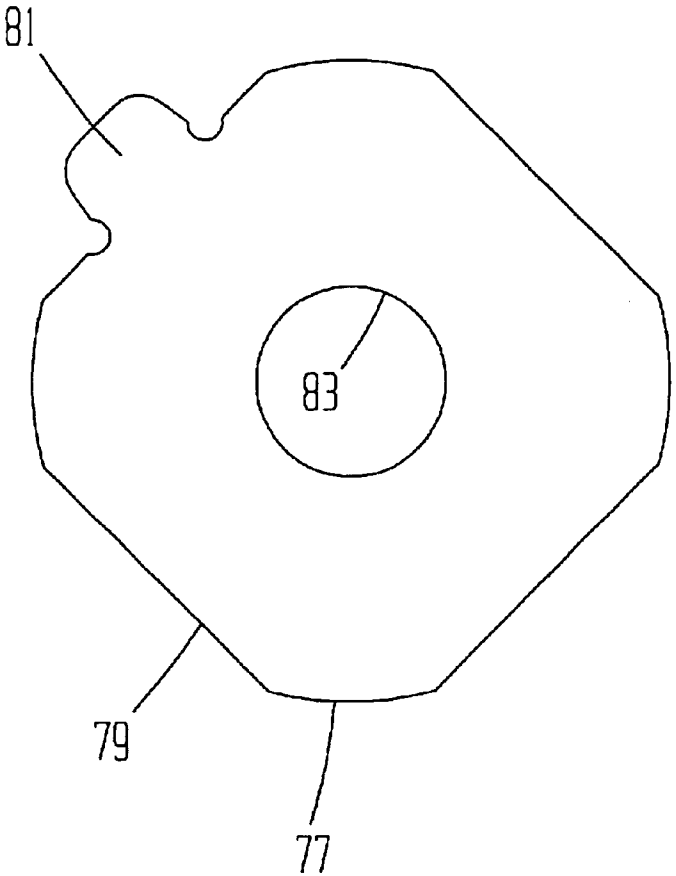
FIG. 5 is a bottom view of the template of the invention.
Figure 7:
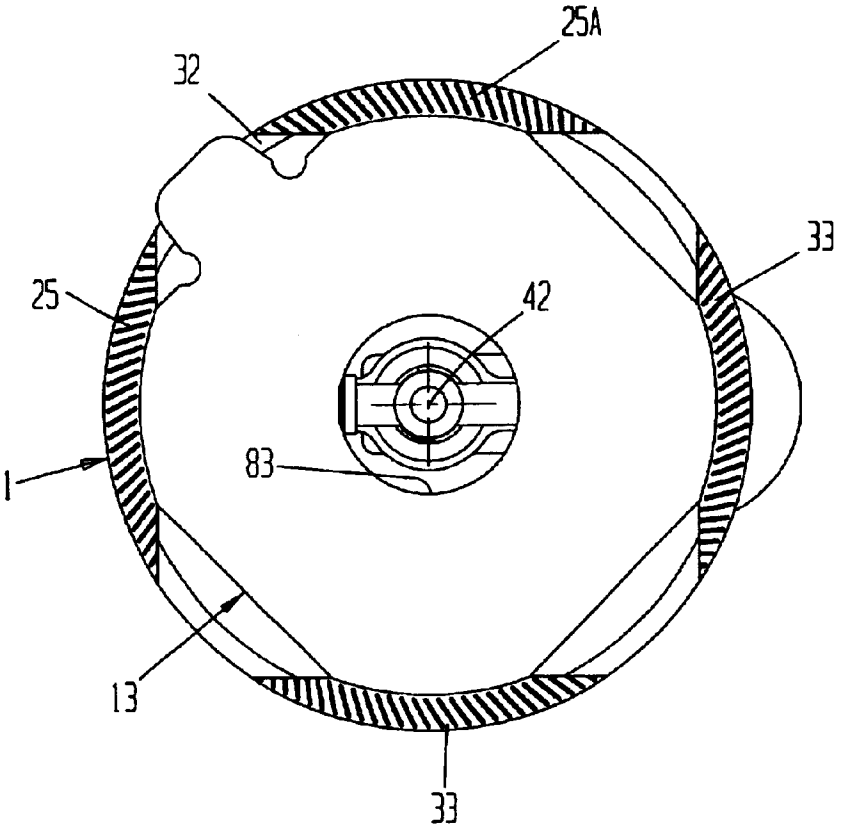
FIG. 7 is a view similar to FIG. 6, but showing the template installed in the circle cutting machine.
Figure 6:
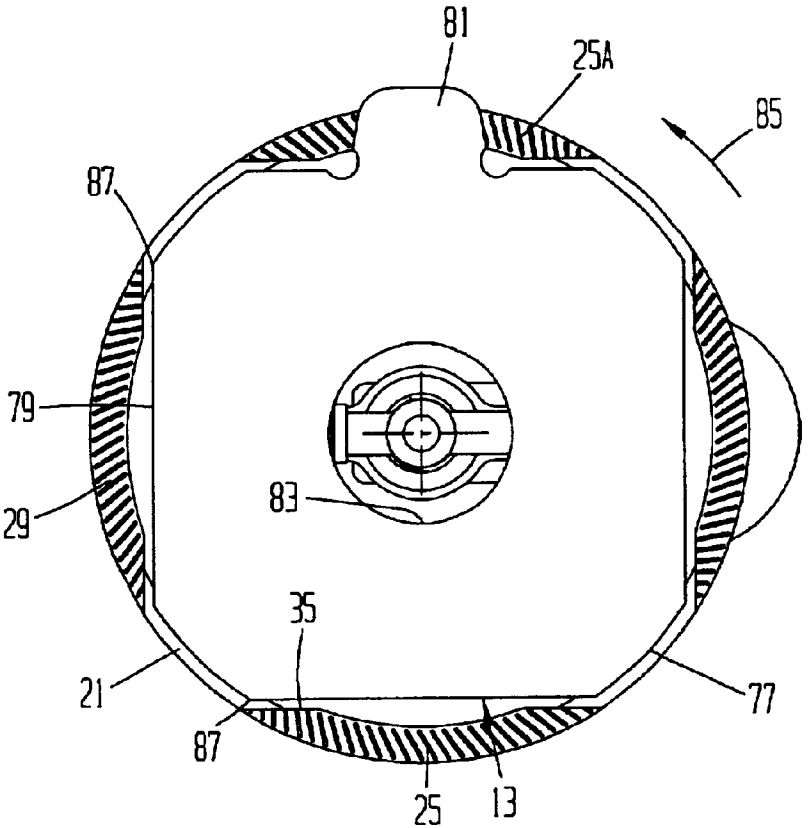
FIG. 6 is a bottom view of the circle cutting machine at a first step of installing the template.
Figure 8:
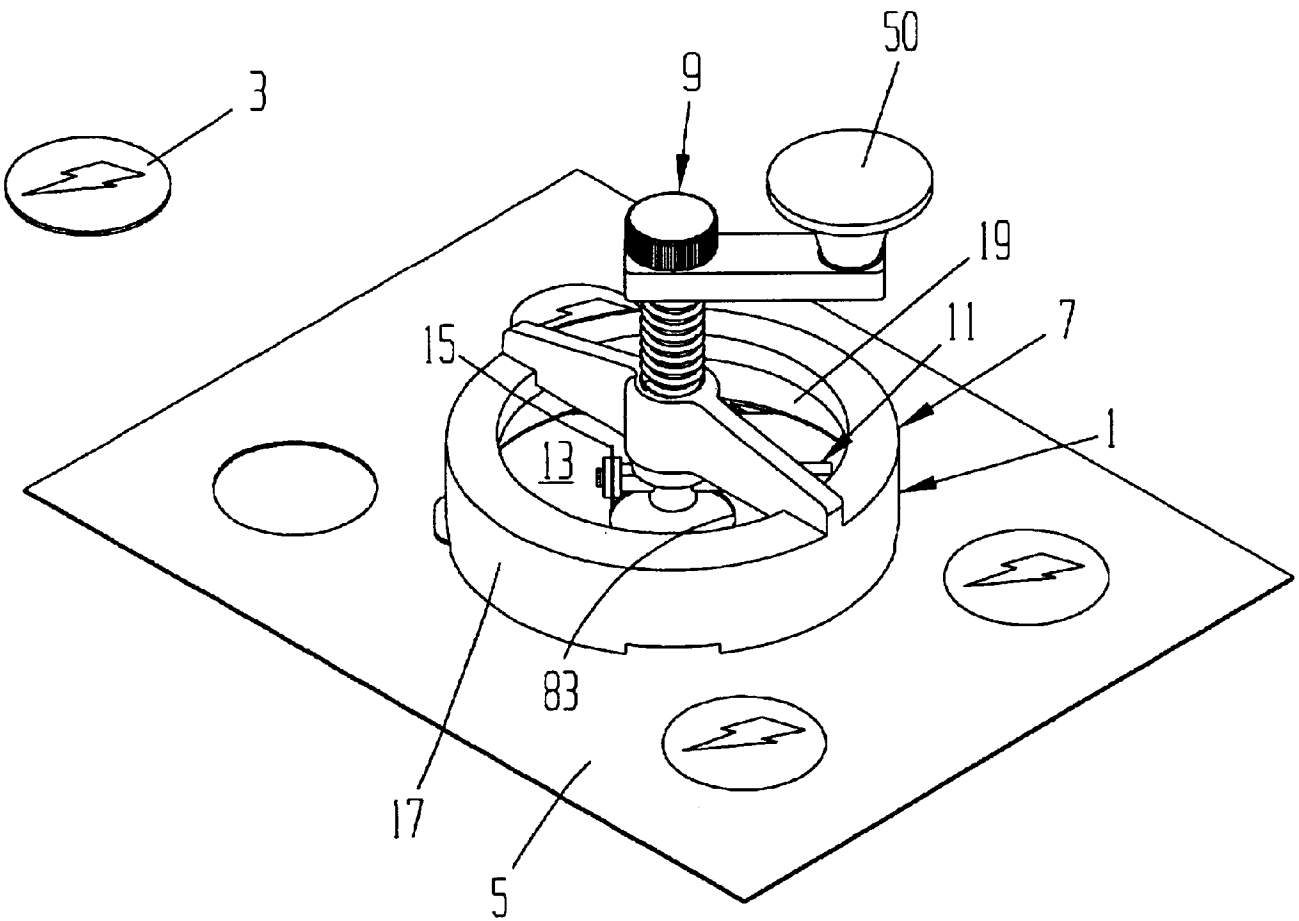
FIG. 8 is a perspective view showing the circle cutting machine in use to cut pieces from a sheet of material.

Further in accordance with the present invention, the template 13 aids in centering the circle cutting machine 1 over a piece 3 on a sheet 5. Looking also at FIGS. 5–7, the template is formed from a tough resilient material such as high impact polystyrene or ultra high molecular weight polyethylene. The thickness of the template is slightly less than the width W of the grooves 31 in the base 7. The combination of the template material and thickness renders the template slightly flexible. The template has a circular periphery 77 of a diameter slightly less than the diameter D of the base grooves. The template has a number of flats 79 that is preferably equal to the number of base segments 25. The flats 79 are located and spaced apart to correspond with the inside edges 35 of the segments second legs 29. On one of the flats is a tab 81. The template may have a center guide hole 83.

To install the template 13 in the base 7, the template is initially laid such that its circular periphery 77 rests on the base bottom surface 21, and the template flats 79 are fit alongside associated inside edges 35 of the segments second legs 29. The tab 81 overlies any one of the segments, such as segment 25A. The template tab is pivoted in either direction, such as in the direction of arrow 85. The junctions 87 between the circular periphery and the adjacent flats enter the base grooves 31. The template is pivoted until the tab is in a gap 32 between two segments, FIG. 7. The resiliency of the template material causes the tab to automatically drop into the gap. The tab is thus positively held between the segment 25A and the adjoining segment 25, so there is no possibility that the tab will pivot unintentionally within the base. The entire circular periphery enters the base grooves, and the template flats are generally aligned with the gaps 32 between the segments 25. When the template is installed it lies in a single plane, and it is not below the plane of the segments undersurfaces 33.

If the template 13 has a guide hole 83 in it, the guide hole is concentric with the axis of rotation 42 when the template is installed in the circle cutting machine 1. The handle adjuster 48 is adjusted to enable the cutting arm bar 59 to slide in the shaft cross-hole 61. The cutting arm bar is slid such that the cutting wheel 15 is at the same radius as the guide hole. The detents 73 assist in setting a standard size radius. Alternately, the bar can be turned in the shaft cross-hole 61 such that the adjuster ball 55 can press against any point on the bar cylindrical surface 74.

The sheet 5 is placed on a flat, smooth, and hard surface, not shown, such as a flat piece of metal or glass. The circle cutting machine base 7 is placed on the sheet. The knurled undersurfaces 33 of the segments 25 resist sliding of the machine 1 on the sheet. The template guide hole 83 is placed over the piece 3 to be cut, FIG. 8. The template is spaced from the sheet by the thickness T of the segments second legs 29. The user pushes the template 13 close to the guide hole against the sheet. The flexible nature of the template material enables it to deflect sightly through the distance T and contact the sheet, thereby eliminating any parallax and enabling exact centering of the machine over the piece to be cut. A person holds the machine base 7 firmly in place with a first hand. With his second hand, he pushes the handle knob 50 toward the sheet, and rotates the handle 9 about the axis of rotation 42. That action cuts a perfect circular piece.

The long length of the handle shaft 43 above the base cross-beam 39 assures ample clearance between the crank 45 and the person's first hand. The cutting wheel 62 and the double edge static blade 76 both allow bidirectional rotation of the handle.

If the template 13 does not have a guide hole 83, or if the guide hole is too small for the size piece 3 to be cut, the cutting arm 11 is adjusted to provide the desired radius to the cutting element 15. After the template is installed in the base 7, the circle cutting machine 1 is placed on a flat, smooth, and hard surface. The handle 9 is pushed and rotated to cut the guide hole from the template concentric with the axis of rotation 42. In that manner, a series of interchangeable templates with different size guide holes can be obtained to suit the diameters of different pieces.

Figure 3:
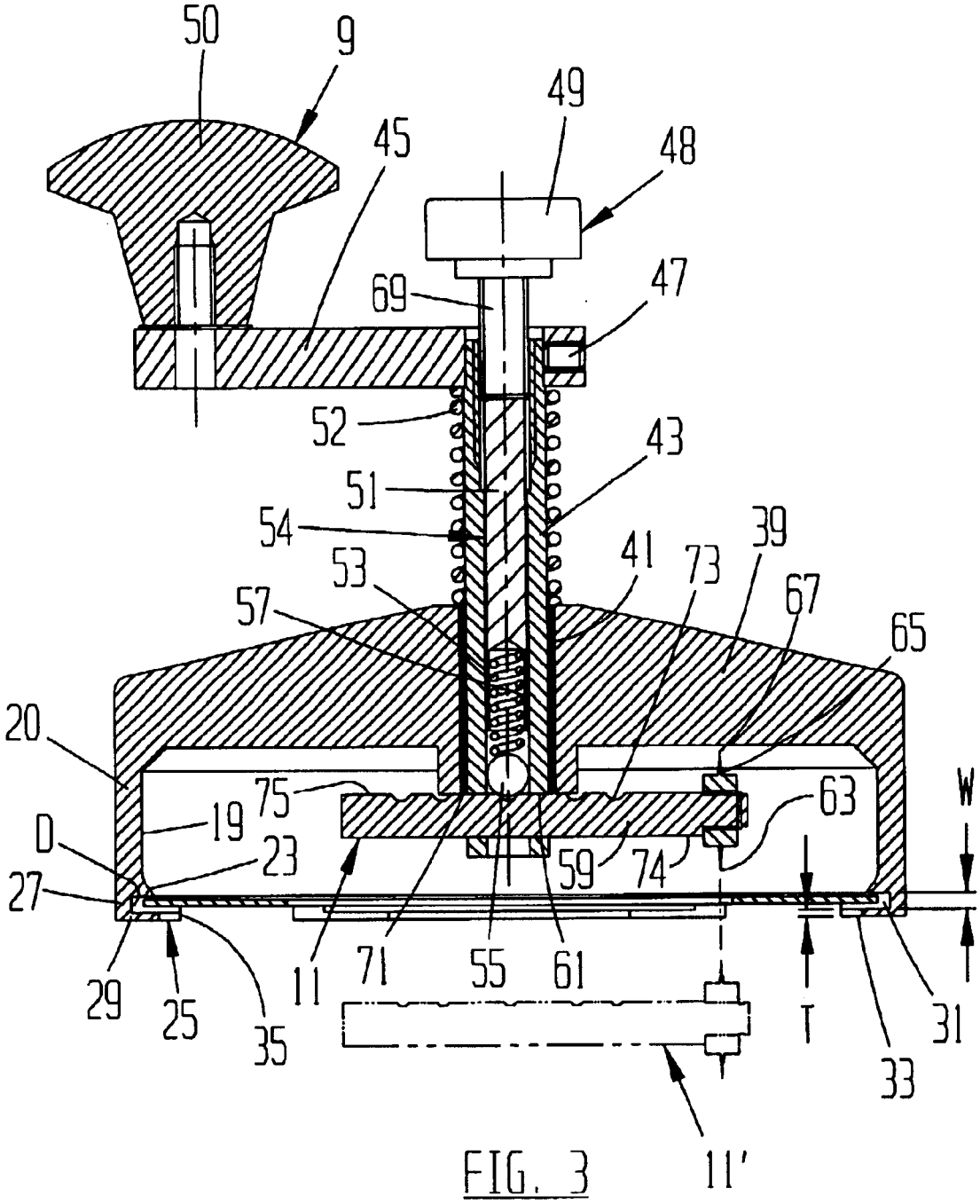
FIG. 3 is a cross-sectional view taken along line 3—3 of FIG. 2 showing the cutting arm resiliently unlocked from the handle.
Figure 3A:
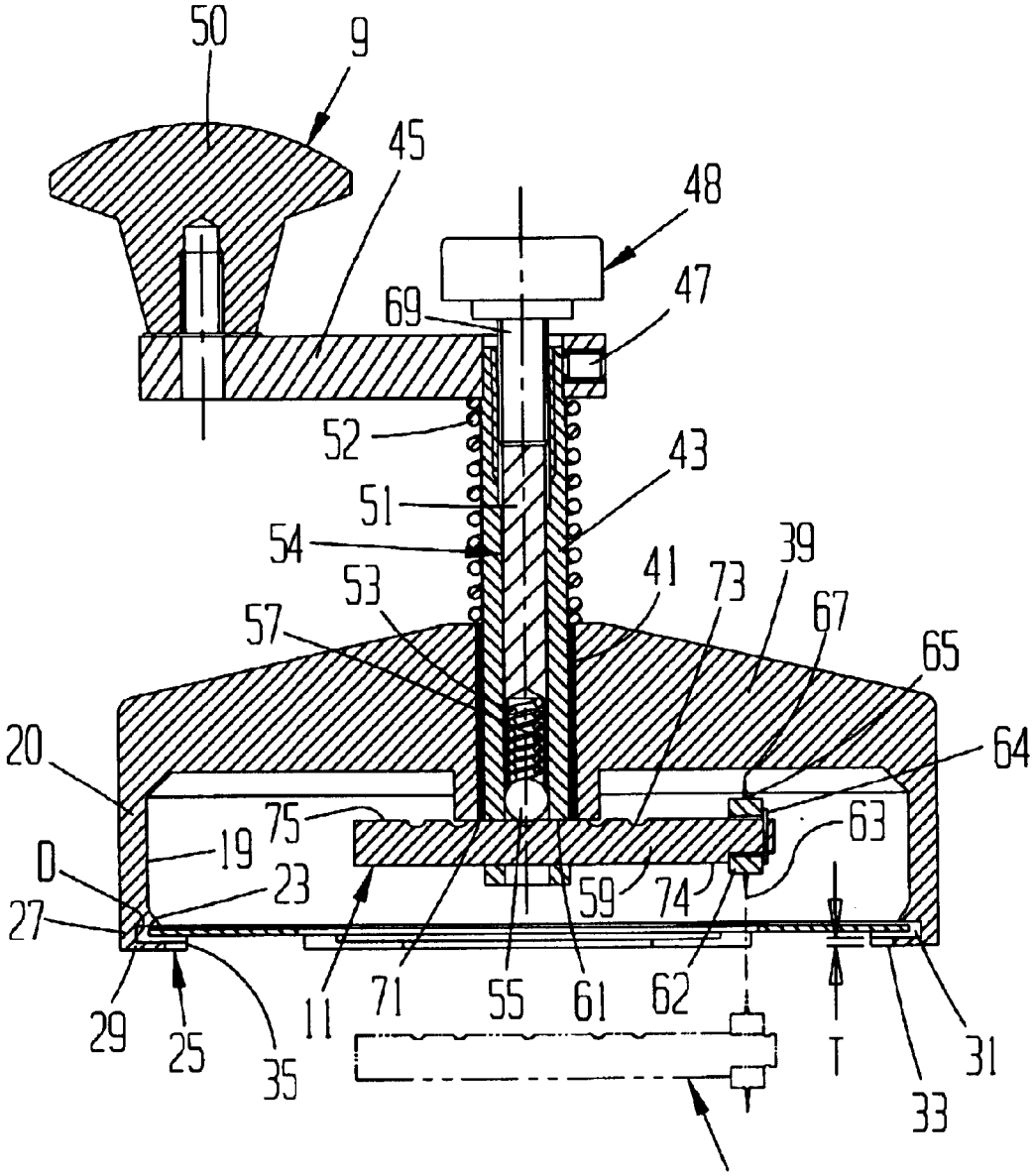
FIG. 3A is a cross-sectional view similar to FIG. 3, but showing the cutting arm rigidly locked to the handle.

It is an important feature of the present invention that the cutting arm bar 59 can be removed from the circle cutting machine 1 without using any tools. Further, removal of the cutting arm bar is accomplished without disassembling the handle 9 from the the base 7. As best shown in FIG. 3, the length of the shaft 43 above the base cross-beam 39 is normally greater than the distance between the shaft cross-hole 61 and the base bottom surface 21. By holding the circle cutting machine base away from any obstruction and pushing the handle to slide in the center bearing 41 toward the cross-beam 39 against the handle spring 52, the cutting arm 11 is completely exposed outside of the base, as is shown by phantom lines 11' in FIG. 3. The adjuster knob 49 is turned to loosen the cutting arm bar 59 and enable it to be removed from the shaft 43 for replacing the cutting wheel 62 or other cutting element. Also, reducing the compression in the adjuster spring 53 is effective in preventing the ball 55 from projecting from the shaft 43 when the cutting arm 11 is removed from the shaft.

In summary, the results and advantages of circular pieces 3 of thin material 5 can now be more fully realized. The circle cutting machine 1 provides both accurate cutting of circular pieces as well as easy adjustment for different size pieces. This desireable result comes from using the combined functions of the template 13. The template is easily installed and removed from the bottom of the base 7 by means of the grooves 31. Different templates have different size guide holes 83 to suit different size pieces to be cut. The adjuster 48 enables easy adjusting of the cutting arm 11 to the proper cutting radius. The detents 73 in the cutting arm bar 59 simplify bar adjustment for standard size pieces, and the cylindrical bar surface 74 enables an unlimited number of sizes to be cut.

It will also be recognized that in addition to the superior performance of the circle cutting machine 1, its construction is such as to cost little, if any, more than traditional circle cutting machines. In fact, the increased productivity available from the invention quickly recoups its initial cost.

Thus, it is apparent that there has been provided, in accordance with the invention, a circle cutting machine that satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A circle cutting machine comprising:

a. a base having a bottom surface that defines a bottom plane, the base further defining an axis of rotation;

b. a handle in the base and rotatable about the axis of rotation;

c. a cutting arm slideable in the handle and having a cutting element;

d. means for both resiliently unlocking and rigidly locking the cutting arm to the handle; and e. a template removeably installable in the base.

2. The circle cutting machine of claim 1 wherein the template has a guide hole therethrough substantially concentric with the base axis of rotation.

3. A circle cutting machine comprising:

a. a base having a bottom surface that defines a bottom plane, the base further defining an axis of rotation, wherein the base comprises a plurality of segments with gaps therebetween and having respective legs that cooperate with the base bottom surface to define a base groove associated with each segment;

b. a handle in the base and rotatable about the axis of rotation;

c. a cutting arm slideable in the handle and having a cutting element;

d. means for resiliently unlocking and rigidly locking the cutting arm to the handle; and e. a template removeably installable in the base, wherein the template is removeably installed in the base grooves.

4. A circle cutting machine comprising:

a. a base having a bottom surface that defines a bottom plane, the base further defining an axis of rotation;

b. a handle in the base and rotatable about the axis of rotation;

c. a cutting arm slideable in the handle and having a cutting element;

d. means for resiliently unlocking and rigidly locking the cutting arm to the handle; and e. a template removeably installable in the base, wherein the template has a generally circular periphery, a plurality of flats, and a tab on one of the flats.

5. The circle cutting machine of claim 4 wherein the template tab is positively held in a gap between two segments when the template is installed in the base.

6. Apparatus for cutting circular pieces from a thin sheet of material comprising:

a. a base having a bottom surface that defines a first plane, and a plurality of spaced apart segments that cooperate with the bottom surface to define a plurality of grooves;

b. a handle in the base and rotatable about an axis of rotation;

c. a cutting arm held in the handle and having a cutting element; and d. a template removeably installable into the base grooves, the template having a guide hole that centers over a piece to be cut from the sheet of material, wherein:

i. the handle comprises a shaft with a knob and a resilient locking device inside said shaft; and ii. the knob is selectively adjustable to force the resilient locking device against the cutting arm with a selected force such that the cutting arm is unlockable and lockable to the handle.

* * * * *